US007752977B1

(12) United States Patent
Babcock et al.

(10) Patent No.: US 7,752,977 B1
(45) Date of Patent: Jul. 13, 2010

(54) DECELERATION APPARATUS FOR PROJECTILE

(75) Inventors: Wade Babcock, Waldorf, MD (US); Jeff Guthrie, Rome, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/973,989

(22) Filed: Sep. 19, 2007

(51) Int. Cl.
*F42B 5/24* (2006.01)

(52) U.S. Cl. ..... 102/501; 102/514; 403/223; 285/235

(58) Field of Classification Search ..... 403/223; 285/235; 102/514, 515, 516
See application file for complete search history.

(56) References Cited

U.S. PATENT DOCUMENTS 871,825 A * 11/1907 Schupmann ..... 102/501
5,164,538 A * 11/1992 McClain III ..... 102/517
5,569,874 A * 10/1996 Nelson ..... 102/507
6,182,574 B1 * 2/2001 Giannoni ..... 102/516
6,581,522 B1 6/2003 Julien et al.
6,679,178 B2 * 1/2004 Mihaylov et al. ..... 102/439
7,222,573 B2 * 5/2007 Pontieri ..... 102/501

* cited by examiner

*Primary Examiner*—Troy Chambers
*Assistant Examiner*—Samir Abdosh
(74) *Attorney, Agent, or Firm*—Fredric Zimmerman

(57) ABSTRACT

A decelerating apparatus includes a sleeve having a forward end and a rear end. A plurality of helical grooves formed in the sleeve. Each helical groove begins at the forward end of the sleeve and has a depth that decreases from the forward end of the sleeve towards the rear end. The depth of each helical groove at the forward end of the sleeve is large enough so that the helical groove cuts completely through the sleeve at the forward end. The plurality of helical grooves define deformable petals therebetween.

8 Claims, 2 Drawing Sheets

DECELERATION APPARATUS FOR PROJECTILE

STATEMENT OF GOVERNMENT INTEREST

The inventions described herein may be manufactured and used by or for the Government of the United States of America for government purposes without the payment of any royalties thereon or thereof.

BACKGROUND OF THE INVENTION

The invention relates in general to projectiles and in particular to projectiles that rapidly decelerate upon impact.

In the case of many munitions, it is desirable for the munition to deliver its payload, whether explosive or nonexplosive, upon impact. In these munitions, it is assumed that the point of impact is the desired target. Thus, it is undesirable that the munition continue its travel after impact with the target. Continued travel past the target makes the munition less effective. In the case of projectiles or penetrators, it is necessary to provide a means for slowing the projectile after impact.

Known methods of accomplishing this task usually involve a soft deformable metal nose, some sort of ring shaped flange, or a molybolt-style device that opens petals. All of these designs increase the presented area of the penetrator through deformation of their structure. The "soft" metal approach usually involves lead, which is very dense. Dense metals are difficult to slow down due to their increased kinetic energy and increased mass. Ring flanges are satisfactory until at least one point on the circumference of the flange fails, and then the entire ring fails catastrophically. The molybolt-style devices are effective until individual petals break off. As the petals break off, the braking action of the molybolt-style device is decreased.

SUMMARY OF THE INVENTION

A principle purpose of the present invention is to provide a means for slowing a projectile in the most rapid fashion possible on impact in media ranging from sand, soil, concrete, metals, plastics, water, flesh, bone, etc.

One aspect of the invention is a decelerating apparatus which includes a sleeve having a forward end and a rear end. A plurality of grooves are formed in the sleeve. Each groove begins at the forward end of the sleeve and has a depth that decreases from the forward end towards the rear end of the sleeve. More particularly, the plurality of grooves are helical and the depth of each groove at the forward end is large enough so that the groove cuts completely through the sleeve at the forward end.

Another aspect of the invention is a projectile having a body with a decelerating apparatus attached to the body. The decelerating apparatus includes a sleeve having a forward end and a rear end. The sleeve has a plurality of grooves formed in it. Each groove begins at the forward end of the sleeve-and has a depth that decreases from the forward end towards the rear end of the sleeve. More particularly, the plurality of grooves are helical and the depth of each groove at the forward end is large enough so that the groove cuts completely through the sleeve at the forward end.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE EXEMPLARY EMBODIMENTS

Figure 1:
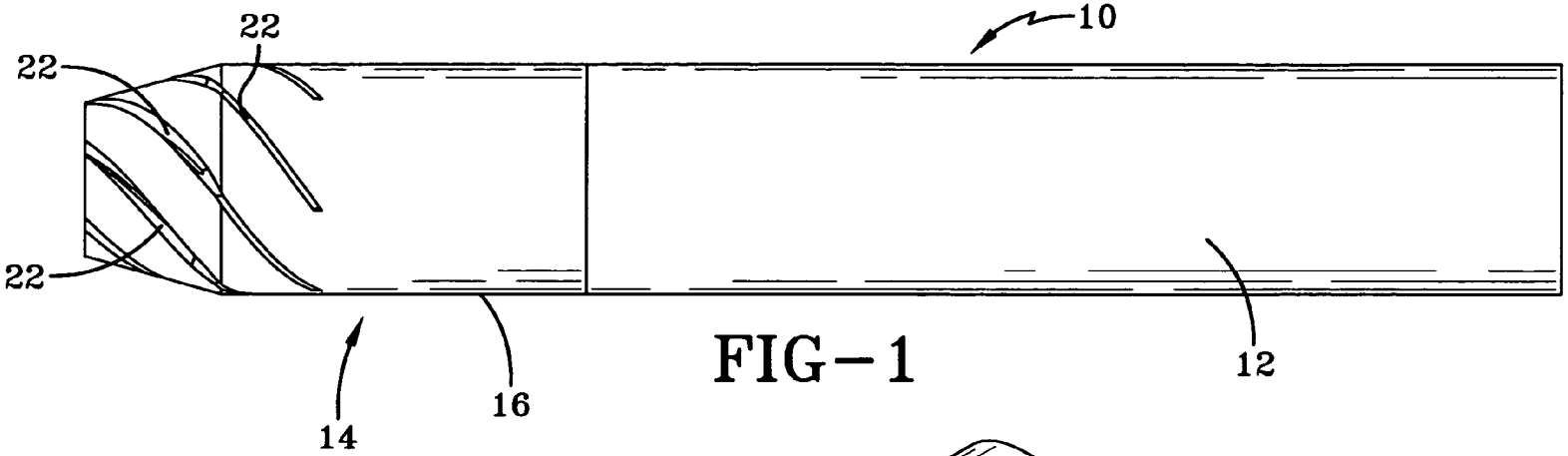
FIG. 1 is a side view of a projectile.

FIG. 1 is a side view of a projectile 10 having a body 12 and a decelerating apparatus (DA) 14 attached to a front end of the body 12. DA 14 may be attached to body 12 by a variety of means, for example, threads, fasteners, or welding. Because DA 14 is the front end of projectile 10, DA 14 will be the first part of projectile 10 to impact a target.

As shown in detail in FIGS. 2 through 5, DA 14 includes a sleeve 16 having a forward end 24, a rear end 26, and a plurality of grooves 22 formed therein. Each groove 22 begins at the forward end 24 of the sleeve 16. Each groove 22 has a depth that decreases from the forward end 24 of the sleeve towards the rear end 26. More particularly, the grooves 22 are helical, although grooves having orientations other than helical are within the scope of the invention.

Figure 2:
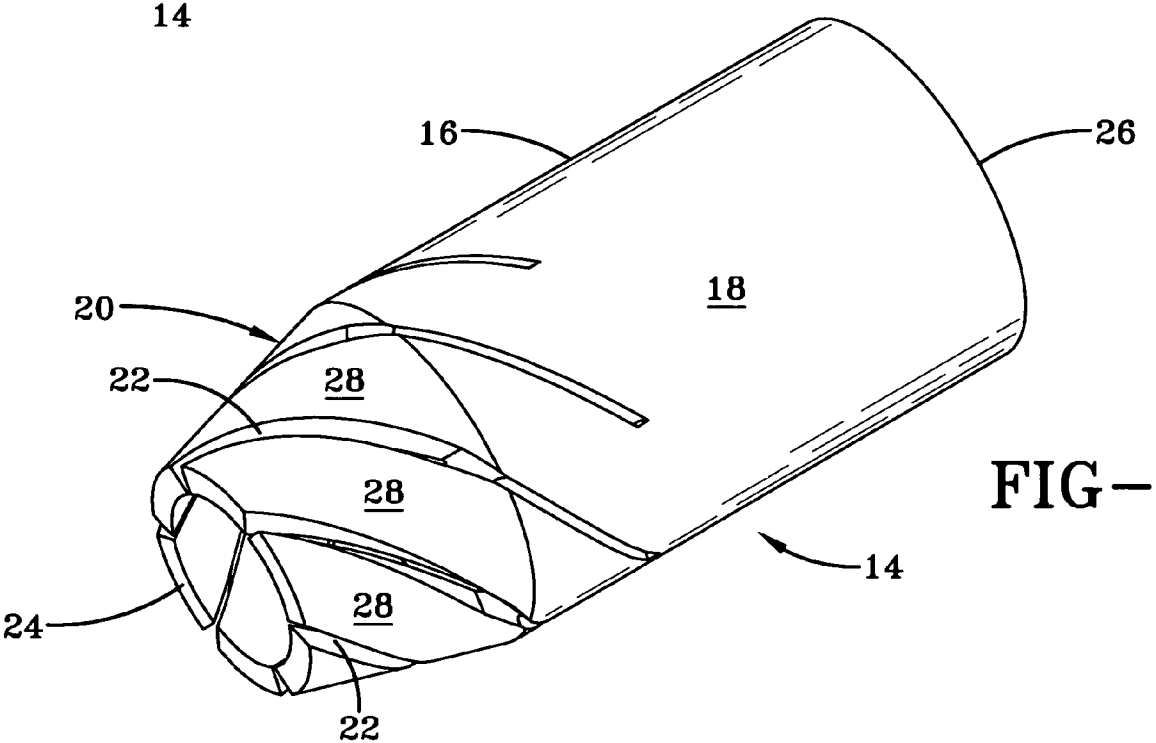
FIG. 2 is a perspective view of a decelerating apparatus.
Figure 4:
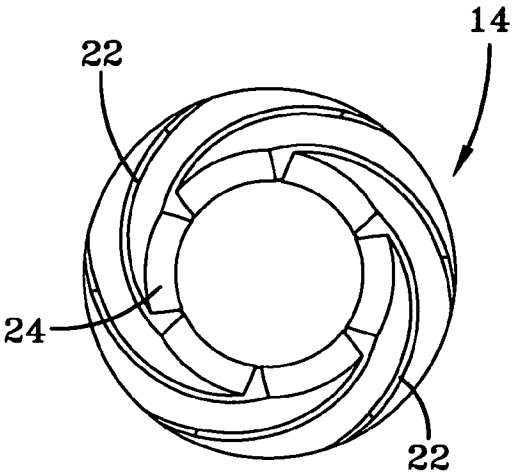
FIG. 4 is an end view of the decelerating apparatus of FIG. 3.

As best seen in FIGS. 2 and 4, the depth of each groove 22 at the forward end 24 is large enough so that the groove 22 cuts completely through the sleeve 16 at the forward end 24. The grooves 22 are cut into the sleeve 16, beginning at the forward end 24 and proceeding aft towards the rear end 26. At first the groove 22 cuts all the way through the thickness of the sleeve 16. As the groove proceeds aft, it begins to only cut part way through the thickness of the sleeve 16. At the very end of the groove 22, it simply disappears as if the cutting tool were slowly pulled away from the sleeve 16. In one embodiment, the groove 22 makes 90 degrees of rotation in about 0.5 inches of length.

The plurality of grooves 22 define deformable petals 28 therebetween. In the embodiment shown in FIG. 4, the number of grooves 22 is six and the number of petals 28 is six. However, more or less than six grooves may be used. In the exemplary embodiment as illustrated, the grooves 22 are evenly spaced circumferentially around the sleeve 16 and each groove 22 is generally V-shaped.

Figure 3:
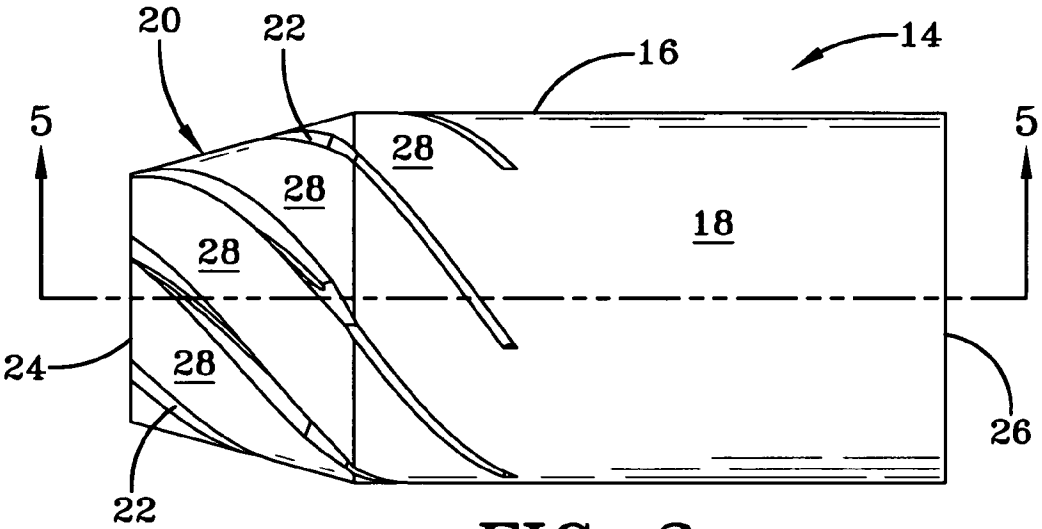
FIG. 3 is a side view of the decelerating apparatus of FIG. 2.
Figure 5:
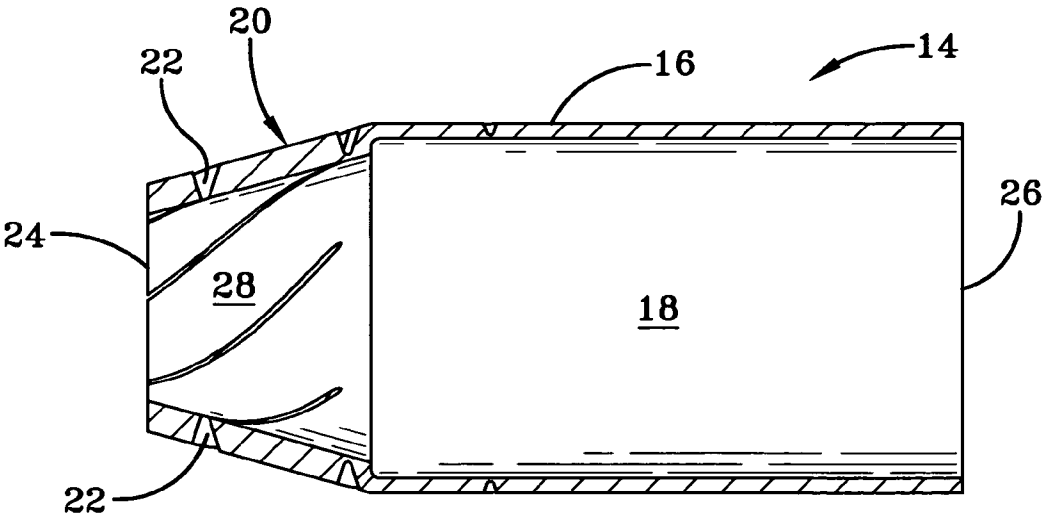
FIG. 5 is a sectional view taken along the line 5-5 of FIG. 3.

The sleeve 16 shown in the FIGS. 2, 3 and 5 includes a conical portion 20 followed by a cylindrical portion 18. In other embodiments, the sleeve 16 may be entirely cylindrical or entirely conical. As shown in the FIG. 3, it is preferable that the plurality of grooves 22 extend from the conical portion 20 into at least a part of the cylindrical portion 18.

Upon impact, the DA 14 deforms in such a way as to increase the presented area of the projectile 10 into the flow of material around it. This action absorbs the kinetic energy of the projectile 10, allowing it to slow down. The DA 14 enables two distinct mechanisms to take place during deformation. First, although the forward end of the grooves 22 are cut completely through the sleeve 16, the remaining portion of the grooves 22 are not cut all the way through the sleeve 16. Thus, in forming the petals 28, the sleeve material has to tear along the grooves 22, thereby consuming large amounts of energy. Second, as the grooves 22 tear and the sleeve material folds back to form the petals 28, the "mushrooming" nature of the helical petals 28 and their tendency to deform into a clumped mass also absorbs energy.

In operation, the impacting media deforms the petals 28 rearwards forcing the sleeve 16 material to tear along the helical grooves 22, effectively smashing and mushrooming the petals 28 into a mass of mangled metal in a ring shape near the ends of the grooves 22. The combination of the tearing of the sleeve 16 material and deformation within the petals 28 both consume energy. In addition, as the mushrooming ring is formed, there is a dramatic increase in presented area that increases the consumption of energy as the projectile 10 impinges on the impact material. As the helical petals 28 deform they become intertwined and locked, providing some structural benefit and helping them to stay in the flow of media longer. Similarly, as the petals 28 continue to deform under more and more applied force, they simply "peel" back the material of the sleeve 16 like peeling the paper covering off of a drinking straw.

More particularly, the DA 14 is made of a lightweight material, such as low density metals like Al, Mg, Ti, or polymers, or composites. An advantage of using lightweight materials is that their lower density makes them easier to decelerate, thus enabling more dynamic projectile design and function. In contrast, in the past, the purpose of soft metals and expanding tips in bullets was to present more surface area to thereby increase lethality, but there was no desire to reduce kinetic energy. Thus, in the past, the use of high density lead was appealing. The density of the expected media that the DA 14 will impact determines the material of the DA 14. For example, a plastic or thin metal sleeve may be appropriate for impact with water or flesh; a thick plastic or thin metal sleeve for impact with sand, plastic, or thin metals; and a thicker, stiffer metal sleeve for impact with hard soil or thicker metals.

DA 14 may be fabricated by any of various techniques including casting, molding, machining, or extrusion. DA 14 may be fabricated integrally with the forward portion of a projectile's body 12, or as an add-on structure.

While the invention has been described with reference to certain exemplary embodiments, numerous changes, alterations and modifications to the described embodiments are possible without departing from the spirit and scope of the invention as defined in the appended claims, and equivalents thereof.

Finally, any numerical parameters set forth in the specification and attached claims are approximations (for example, by using the term "about") that may vary depending upon the desired properties to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A projectile, comprising:

a body; and a decelerating apparatus attached to the body, wherein the decelerating apparatus comprises a sleeve having a forward end and a rear end, a plurality of grooves formed in the sleeve where each of said plurality of grooves begins at the forward end of the sleeve having a depth that decreases from the forward end towards the rear end of the sleeve, wherein the plurality of grooves defines deformable petals therebetween, wherein the plurality of grooves are helical grooves oriented around the sleeve to define locations of deformation for dissipation of energy, wherein each of the plurality of grooves is generally V-shaped, and wherein said forward end comprises a flat surface where the plurality of grooves extend downward from the flat surface toward the rear end.

2. The projectile of claim 1, wherein the sleeve forms a front end of the projectile.

3. The projectile of claim 1, wherein the depth of each groove at the forward end of the sleeve is large enough so that the groove cuts completely through the sleeve at the forward end.

4. The projectile of claim 1, wherein the plurality of grooves is six grooves.

5. The projectile of claim 1, wherein the sleeve comprises a cylindrical portion.

6. The projectile of claim 1, wherein the sleeve comprises a conical portion.

7. A projectile, comprising:

a body; and a decelerating apparatus attached to a front end of the body, wherein the decelerating apparatus comprises a sleeve having a forward end and a rear end, a plurality of helical grooves formed in the sleeve where each of the plurality of helical groove begins at the forward end of the sleeve, wherein each of the plurality of helical grooves has a depth that decreases from the forward end of the sleeve towards the rear end, the depth of each helical groove at the forward end of the sleeve being large enough so that the helical groove cuts completely through the sleeve at the forward end; the plurality of helical grooves defining deformable petals therebetween, wherein each of the plurality of helical grooves is generally V-shaped, wherein said forward end comprises a flat surface where the plurality of helical grooves extend downward from the flat surface toward the rear end, and wherein the plurality of helical grooves are oriented around the sleeve to define locations of deformation for dissipation of energy.

8. The projectile of claim 7, wherein the sleeve comprises a cylindrical portion and a conical portion, and wherein the conical portion at the forward end is followed by the cylindrical portion.

* * * * *